US006590340B1

(12) United States Patent
Eijsermans et al.

(10) Patent No.: US 6,590,340 B1
(45) **Date of Patent: *Jul. 8, 2003**

(54) HIGH PRESSURE DISCHARGE LAMP WITH TUNGSTEN ELECTRODE RODS HAVING FIRST AND SECOND PARTS

(75) Inventors: Joseph F. R. Eijsermans, Eindhoven (NL); Dorothea Seebode, Aachen (DE); Angela Jörres, Julich (DE)

(73) Assignee: Koninklijke Philips Electronics N.V., Eindhoven (NL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/338,051

(22) Filed: Jun. 22, 1999

(30) Foreign Application Priority Data

Jun. 30, 1998 (EP) ..... 98202197

(51) Int. Cl.[7] ..... H01J 17/18; H01J 61/36

(52) U.S. Cl. ..... 313/623; 313/631; 313/633; 313/634; 313/332

(58) Field of Search ..... 313/623, 634, 313/331, 332, 318.01, 631, 633

(56) References Cited

U.S. PATENT DOCUMENTS 3,716,743 A * 2/1973 Mizuno et al. ..... 313/625
4,413,205 A * 11/1983 Ooms ..... 313/579
5,004,951 A * 4/1991 Honda et al. ..... 313/631
5,159,239 A * 10/1992 Ekkelboom et al. ..... 313/623
5,461,277 A * 10/1995 Van Gennip et al. ..... 313/331
5,568,008 A * 10/1996 Narita ..... 313/113
5,585,694 A * 12/1996 Goldburt et al. ..... 313/491
5,754,005 A * 5/1998 Sakoske et al. ..... 313/623
6,060,829 A * 5/2000 Kubon et al. ..... 313/631
6,169,365 B1 * 1/2001 Kubon et al. ..... 313/631

FOREIGN PATENT DOCUMENTS

DE 3536553 10/1985 ..... H01J/61/04
EP 609477 2/1993 ..... H01J/61/36
EP 581354 7/1993 ..... H01J/61/36

* cited by examiner

*Primary Examiner*—Vip Patel
*Assistant Examiner*—Kevin Quarterman
(74) *Attorney, Agent, or Firm*—Dicran Halajian

(57) ABSTRACT

The high-pressure discharge lamp comprises a sealed lamp vessel (1) having a quartz glass wall (2) enclosing a discharge space (3). Metal foils (4) are embedded in the wall, connected to electrode rods (6*a*) projecting from the wall into the discharge space. The electrode rods (6*a*) have a first part (7*a*) and a second part (7*b*). The second part is made of tungsten with a diameter of 120 to 180 $\mu$m or molybdenum with a diameter of 120 to 350 $\mu$m, or tungsten-molybdenum mixtures with a diameter of 120 to 350 $\mu$m. The second part, which is positioned within the wall (2), prevents premature failure of the lamp caused by leakage.

23 Claims, 2 Drawing Sheets

HIGH PRESSURE DISCHARGE LAMP WITH TUNGSTEN ELECTRODE RODS HAVING FIRST AND SECOND PARTS

BACKGROUND OF THE INVENTION

The invention relates to a high-pressure gas discharge lamp comprising:

- a lamp vessel which is closed in a vacuumtight manner and has a quartz glass wall enclosing a discharge space;
- metal foils embedded in the wall of the lamp vessel and each connected to a respective external current conductor;
- tungsten electrode rods each connected to a respective one of said metal foils and projecting from the wall of the lamp vessel into the discharge space;
- an ionizable filling in the discharge space;
- the lamp being defined by the following relation $$f_{inw} >= 40\%$$

in which:

$f_{inw}$=fraction of length of the electrode rod enclosed in the wall of the lamp vessel.

A high-pressure gas discharge lamp of this type is known from U.S. Pat. No. 5,462,277. The known lamp is suitable for use as a vehicle headlamp and has electrode rods of a thickness of 250 $\mu$m which may or may not have an envelope at their free ends and may be made of, for example, thoriated tungsten.

Stringent requirements are imposed on the speed with which the lamp, after it has been ignited, provides a large fraction of the luminous flux during stable operation. It is also necessary that the lamp can be ignited while it is still hot due to a previous operating period. The lamp is ignited at a voltage of several kV and a frequency of several kHz in order to comply with these requirements.

In the manufacture of the known lamp, a seal is made in which one or several of said metal foils are enclosed in the wall. During this operation, the quartz glass is softened at the area where this seal is to be created in the presence of the metal foil, the external current conductor and the electrode rod. Subsequently, the lamp, or the lamp-to-be, cools down. Due to its relatively high coefficient of linear thermal expansion (approximately $45*10^{-7}$ $K^{-1}$), the electrode rod then contracts more strongly than the quartz glass in which it is embedded. Quartz glass is a glass having an $SiO_2$ content of at least 98% by weight, the coefficient of expansion of the glass is approximately $6*10^{-7}$ $K^{-1}$. For a good adhesion between the rod and the quartz glass, obtained by an additive to the electrode rod tungsten, such as thorium oxide, a coating of quartz glass around the rod is obtained, which is mechanically unconnected with the quartz glass of the wall. If the electrode rod and the quartz glass adhere insufficiently to each other, a capillary space is created due to shrinkage around this rod. No such capillary space is created around the metal foil, often a molybdenum foil, because of the foil shape.

In the known lamp, there is often a good adhesion between the rod and the quartz glass and thus there is a coating of quartz glass around the rod. The quartz glass coating of the electrode rods in the known lamp enhances their thermal capacity (the energy which is necessary for the same rise of temperature) and also increases their thermal conductance (the quantity of heat which can be depleted per unit of time). On the other hand, their electrical conductivity is not affected. The higher thermal capacity retards the rise of temperature of the rods during ignition of the lamp, so that the permanent contact with the embedded metal foil enables the surrounding quartz glass of the wall to assume a higher temperature and to expand, also because of the heat developed in this foil due to the passage of current.

It has been found that the coatings of species of one type of lamp may have alternating lengths. This may be due to small variations of temperature of the quartz glass when the seal is being made. It is a drawback that the absence of a coating or an insufficient coating results in rejects during the lamp production and that the known lamp has only a short lifetime when there is no or not enough quartz glass coating and when this lamp is often switched on and switched off after a short operating period.

When such a lamp without coating is ignited, the temperature of the electrode rods rises steeply owing to the high current flowing through them and owing to heat transfer from the discharge. The quartz glass does not instantaneously follow this temperature rise. Owing to their higher temperature and their higher coefficient of expansion, the rods will come into contact with the quartz glass and exert pressure on it. It was found that damage, such as microcracks, then occurred in the quartz glass, which microcracks generally increase in number and size during subsequent ignition periods. This leads to a (premature) end of the lifetime of the lamp owing to leakage, causing constituents of the filling to escape so that the lamp no longer ignites, or the lamp vessel is broken.

Lamps complying with the relation $f_{inw}$>=40% have a greater risk of occurrence of the above-mentioned detrimental phenomena, unless special circumstances are created, for example, a quartz glass coating around the electrode rod.

Another drawback is that the coating leads to unwanted and troublesome reflections of the light generated in the discharge.

SUMMARY OF THE INVENTION

It is an object of the invention to provide a high-pressure gas discharge lamp having a simple construction and counteracting said drawbacks.

According to the invention, the electrode rods have first parts projecting into the discharge space, which first parts are at least substantially made of tungsten, and second parts enclosed at least partly in the wall, which second parts are made of elements chosen from the group of tungsten having a thickness ranging between 120 $\mu$m and 180 $\mu$m, molybdenum having a thickness ranging between 120 $\mu$m and 350 $\mu$m and tungsten-molybdenum alloys having a thickness ranging between 120 $\mu$m and 350 $\mu$m, said first and second parts contacting and being connected to each other via facing ends.

Since the electrodes are composed of a first and a second part, it is possible to adapt the electrodes to the circumstances. The first part is made in conformity with the end of the electrode of the known lamp projecting into the discharge space, so that, during its lifetime, it can withstand the heat developed by the high starting currents and the discharge. The second part is designed in such a way that the problem of leakage or breakage of the lamp owing to expansion and, consequently, exertion of pressure on the quartz glass by the second part of the electrode rod during (re)ignition of the lamp at least substantially does not occur anymore.

It has been found that in lamps complying with the relation $f_{inw}$>=40%, the occurring problems of leakage at least substantially do not occur in electrode rods having relatively small thicknesses of the second parts enclosed in the wall. In lamps having electrode rods with second parts of tungsten having a thickness of 180 μm, it was found that leakage of the lamp only occurred sporadically. At thicknesses of less than 180 μm, the absolute value of the expansion, and hence the pressure exerted by the electrode rods on the quartz glass, is so small that any further damage, such as microcracks, no longer occurs.

In lamps having electrode rods with second parts of both tungsten-molybdenum alloys and molybdenum having a thickness of 350 μm, it was found that leakage of the lamp only occurred sporadically. The risk of leakage or breakage of the lamp is considerably reduced if the thickness of these second parts is chosen to be smaller than 350 μm. The successful use of relatively large thicknesses with second parts of molybdenum or tungsten-molybdenum alloys is based on the ductility of these materials. When exerting pressure on the quartz glass, due to expansion by the electrodes, this pressure will be more evenly distributed due to deformation of the relatively ductile material than when using electrodes which are made of, for example, the much less ductile tungsten.

However, for second parts made of both tungsten, tungsten-molybdenum alloys and molybdenum having thicknesses of less than 120 μm, the electrodes only have such a small thermal capacity due to their slight mass and also only a small thermal conductance due to their relatively small diameter that the electrode consequently becomes relatively hot during starting of the lamp. Although small capillary spaces have formed during embedding in the quartz glass due to the relatively small thicknesses of the second parts, it was found that under the given circumstances the electrode rod in these capillary spaces locally made permanent contact with the wall of the lamp vessel so that the depletion of heat was enhanced in such a way that it adequately compensated the small thermal conductance of the electrode resulting from its relatively small diameter, so that a premature end of the lifetime of the lamp was prevented.

It was found that electrodes having a second part with a thickness of less than 120 μm, for example 100 μm, became too hot and appeared to be deformed and/or melt during lamp operation. Due to the fact that the electrode melts, the length of the discharge arc between the electrodes changes and, consequently, the power consumption during nominal operation of the lamp also changes.

An important advantage of the measure according to the invention is that it provides the possibility of using thorium-free material for the electrode rods without detrimentally influencing the lifetime of the lamp. The capillary spaces which have formed during embedding of the electrode rod in the quartz glass are relatively small in second parts having thicknesses of less than 350 μm. Therefore, this has the additional advantage that no large quantities of salts can accumulate in these capillary spaces, which salts would otherwise have been extracted from the discharge.

The first and the second part of the electrode may be secured to each other by means of conventional techniques, for example laser welding. It is important that a good contact is realized when the first and the second part are secured to each other via the ends of the electrode rods. This is essential for a satisfactory transfer of heat from the first to the second part and it contributes to the fact that the electrode can withstand the heat developed by the high starting currents and the discharge during the lifetime of the lamp.

It is favorable when both the first and the second part is made of tungsten. The first and second parts can then be made by means of etching techniques, for example, pickling, from one piece.

Due to the relatively small thickness of the second part, it is favorable for a robust construction, i.e. to avoid deformation of the electrode, that the first part proximate to its connection with the second part is in permanent contact with the wall of the lamp vessel, for example, partly enclosed in the vessel, for example over a length of 0.1–1.0 mm. The permanent contact with the wall of the lamp vessel of the first parts, proximate to their connection with the second parts, is also favorable for a satisfactory depletion of heat of the composite electrode.

Due to the high starting currents upon ignition of the lamp and the heat developed as a result of the discharge, not only relatively high temperatures occur in the second parts but also in the first parts of the electrodes. In first parts having a thickness of less than 250 μm, there is a relatively great risk of melting of the electrode head. Electrodes having first parts with a thickness of more than 250 μm have a sufficient thermal conductance so that the risk of melting is reduced quite considerably. Moreover, the first parts preferably have a thickness of less than 400 μm. Then there is hardly any risk that the unfavorable effect of lamp flickering will occur, i.e. the point of contact of the discharge arc jumps over the head of the electrode.

The high-pressure gas discharge lamp according to the invention may be used, for example, as a vehicle headlamp, or in an optical system of a different kind. For this purpose, the lamp may be provided with a lamp cap and may or may not be surrounded by an outer envelope. A lamp cap may or may not be integrated with a reflector.

The lengths of the first and second parts are also determined by the total length of the entire electrode. In a favorable embodiment the entire electrode has a length of 4.5 to 7.5 mm, preferably 6 mm. The choice of the length of the separate parts is such that the connection of the first part to the second part is at least substantially located at the boundary surface of the wall and the discharge space, at the location where the electrode projects into the discharge space.

The metal foils may be embedded next to one another in one region of the wall, or in regions situated at a distance from one another, for example, opposite one another. The first parts of the electrode rods may or may not have an enveloping winding at their free ends in the discharge space. The first parts of the electrode rods may be made of undoped tungsten, for example tungsten-ZG, or of doped tungsten such as W with 1.5% by weight of Th. The second parts of the electrode rods may be made of undoped tungsten or molybdenum, for example tungsten-ZG, of tungsten-molybdenum mixtures or of doped tungsten or molybdenum such as Mo with 3% by weight of Y. When doped tungsten is used, a small content of crystal growth-regulating means such as 0.01% by weight in total of K, Al and Si may be added so as to influence the tungsten grain size.

The ionizable filling may comprise, inter alia, a rare gas, mercury and a mixture of metal halides, for example, rare-earth halides which are the halides of the lanthanides, scandium and yttrium.

These and other aspects of the invention are apparent from and will be elucidated, by way of non-limitative example, with reference to the embodiments described hereinafter.

DETAILED DESCRIPTION OF THE PREFERRED EMBODIMENTS

Figure 1:
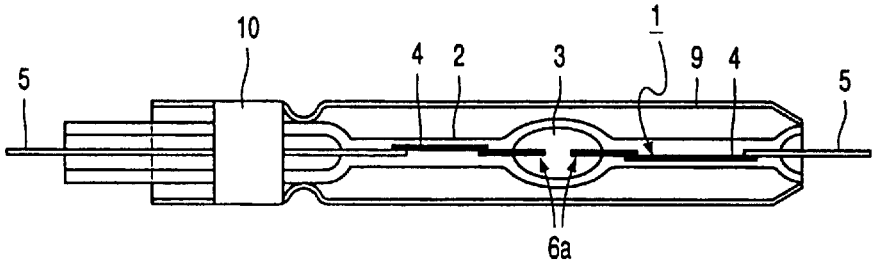
FIG. 1 shows a lamp in a side elevation.

In FIG. 1, the high-pressure gas discharge lamp has a lamp vessel 1 which is closed in a vacuumtight manner and a quartz glass wall 2 enclosing a discharge space 3. Metal foils 4, Mo with 0.5% by weight of $Y_2O_3$ in the Figure, each connected to respective external current conductors 5, of Mo in this embodiment, are embedded in the wall of the lamp vessel. Tungsten electrode rods 6*a* each connected to a respective one of said metal foils 4 project from the wall of the lamp vessel into the discharge space.

An ionizable filling is present in the discharge space 3.

Connected to the metal foils 4 with the external conductors 5 secured thereto, the electrode rods 6*a* are partly enclosed in the wall of the lamp vessel, and the wall is fused with the conductors at the area of these conductors, or the wall has been flattened so as to realize a pinched seal.

In the Figure, the lamp vessel is surrounded by an outer envelope 9 and coupled thereto. The lamp may be gripped by a lamp cap at a metal clamping sleeve 10.

The lamp described has a filling of mercury, sodium iodide and scandium iodide, and xenon, for example, xenon at a pressure of 7 bar at room temperature, and consumes a power of 35 W during operation at rated voltage.

Figure 2A:
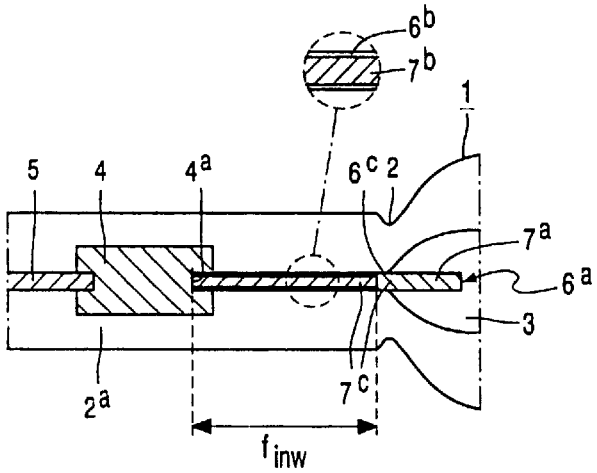
FIGS. 2A and 2B show a detail of FIG. 1 on an enlarged scale.
Figure 2B:
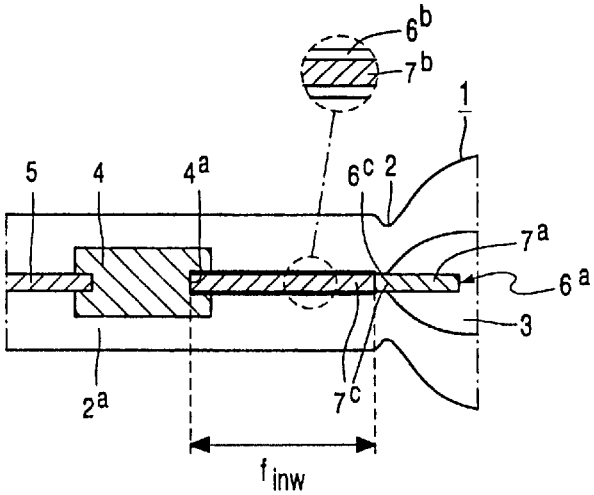

FIGS. 2A and 2B show that the entire electrode rods 6*a* are enclosed in the wall 2 of the lamp vessel 1 over a fraction of length $f_{inw}$ of approximately 75%, so that the lamp complies with the relation $f_{inw}$>=40%. The electrode rods 6*a* each having a length of approximately 6 mm each have a first part 7*a* and a second part 7*b* with a length of approximately 1.5 mm and approximately 4.5 mm, respectively, which are adjacent and connected to each other, for example, by means of a weld via the ends 7*c* of the first and the second part. The ends 7*c* are located near the wall 2 of the lamp vessel 1. The first part 7*a* is in permanent contact with the wall 2 of the lamp vessel 1 at contact area 6*c*, however, without a risk of leakage or breakage of the lamp. The electrode rods 6*a* each have the second part 7*b* in the wall 2, at least proximate to the relevant metal foil 4, which second part is mechanically unconnected with the glass of the wall.

In the embodiment shown in FIG. 2A, the electrode rod 6*a* has a first part 7*a* made of tungsten with a thickness of 300 μm, and a second part 7*b* made of tungsten with a thickness of 150 μm. In the embodiment shown in FIG. 2B, the electrode rod 6*a* has a first part 7*a* made of tungsten with a thickness of 300 μm, and a second part 7*b* made of molybdenum with a thickness of 300 μm. The Figure shows that the second part 7*b* and the capillary 6*b* around it terminate at the weld 4*a* of the rod on the foil. The seal 2*a* is vacuumtight in an area between the external current conductor 5 and the electrode rod 6*a*.

Figure 3:
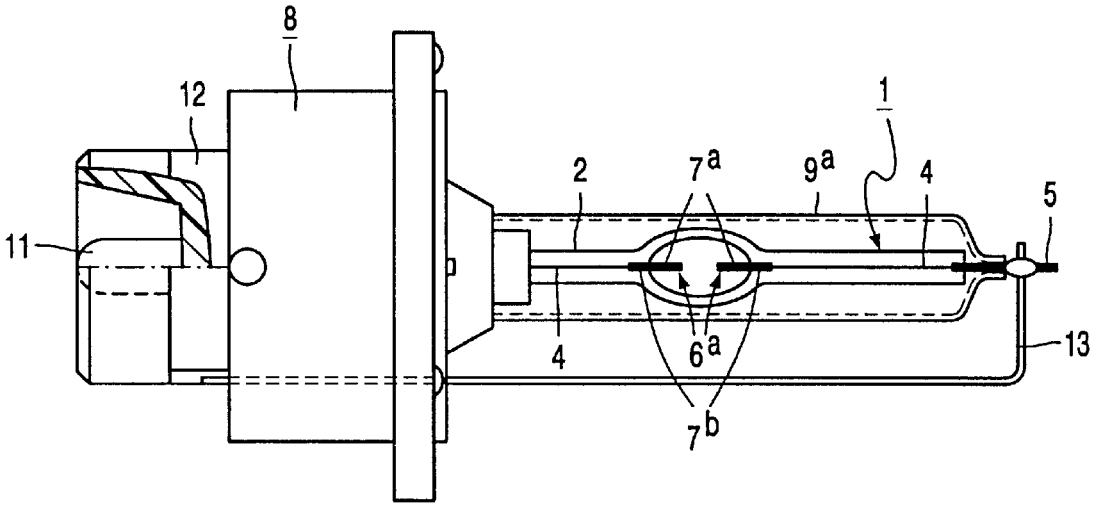
FIG. 3 shows the lamp of FIG. 1 with a lamp cap in a side elevation.

In FIG. 3, the lamp vessel 1 is enclosed in a different outer envelope 9*a* and coupled thereto. The lamp vessel is fixed in a lamp cap 8 of the bayonet type, provided with a central pin contact 11 and a ring contact 12 which are connected to respective electrode rods 6*a*, the ring contact via a connection conductor 13. The lamp vessel 1 provided with such a lamp cap 8 is eminently suitable as a vehicle headlamp.

What is claimed is:

1. A high-pressure gas discharge lamp comprising:

a lamp vessel which is closed in vacuumtight manner and has a quartz glass wall enclosing a discharge space;

metal foils embedded in the wall of the lamp vessel and each connected to a respective external current conductor;

electrode rods each connected to a respective one of said metal foils and projecting from the wall of the lamp vessel into the discharge space;

an ionizable filling in the discharge space;

the lamp being defined by the following relation, $$f_{inw}>=40\%$$

in which:

$f_{inw}$=fraction of length of the electrode rod enclosed in, the wall of the lamp vessel, wherein the electrode rods have first and second discrete parts electrically connected together at facing ends, said first parts projecting into the discharge space and consisting essentially of tungsten, said second parts at least partly enclosed in the wall and consisting essentially of tungsten, molybdenum, tungsten-molybdenum alloys or tungsten, molybdenum, and tungsten-molybdenum alloys.

2. A high-pressure gas discharge lamp as claimed in claim 1, wherein the first parts of the electrode rods are in permanent contact with the wall of the lamp vessel at a contact area.

3. A high-pressure gas discharge lamp as claimed in claim 1 wherein the first parts of the electrode rods have a thickness of 250 μm to 400 μm.

4. A high-pressure gas discharge lamp as claimed in claim 1 wherein the electrode rods have a length of between 4.5 mm and 7.5 mm.

5. A high-pressure gas discharge lamp as claimed in claim 1 further comprising a lamp cap.

6. A high-pressure gas discharge lamp as claimed in claim 1 wherein the second parts of the electrode rods are made of tungsten-molybdenum alloy having a thickness between 120 μm and 350 μm.

7. A high-pressure gas discharge lamp as claimed in claim 1 wherein the second parts of the electrode rods are made of molybdenum having a thickness between 120 μm and 350 μm.

8. A high-pressure gas discharge lamp as claimed in claim 1 wherein the electrode rods do not contain thorium.

9. A high-pressure gas discharge lamp as claimed in claim 1 wherein the first and second parts of the electrode rods are connected by laser welding.

10. A high-pressure gas discharge lamp comprising:

a lamp vessel which is closed in vacuumtight manner and has a wall enclosing a discharge space, metal foils embedded in the wall of the lamp vessel and each connected to a respective external current conductor;

electrode rods each connected to a respective one of said metal foils and projecting from the wall of the lamp vessel into the discharge space;

wherein the electrode rods have first and second discrete parts electrically connected together at facing ends, said first parts projecting into the discharge space and consisting essentially of tungsten, said second parts at least partly enclosed in the wall and consisting essentially of tungsten, molybdenum, tungsten-molybdenum alloys or tungsten, molybdenum and tungsten-molybdenum alloys, said first and second parts being of different thickness.

11. A high-pressure gas discharge lamp as claimed in claim 10, wherein the first parts of the electrode rods are in permanent contact with the wall of the lamp vessel at a contact area.

12. A high-pressure gas discharge lamp as claimed in claim 10 wherein the first parts of the electrode rods have a thickness of 250 $\mu$m to 400 $\mu$m.

13. A high-pressure gas discharge lamp as claimed in claim 10 wherein the electrode rods have a length of between 4.5 mm and 7.5 mm.

14. A high-pressure gas discharge lamp as claimed in claim 10 further comprising a lamp cap.

15. A high-pressure gas discharge lamp as claimed in claim 10 wherein the second parts of the electrode rods are made of tungsten having a thickness between 120 $\mu$m and 180 $\mu$m.

16. A high-pressure gas discharge lamp as claimed in claim 10 wherein the second parts of the electrode rods are made of tungsten-molybdenum alloy having a thickness between 120 $\mu$m and 350 $\mu$m.

17. A high-pressure gas discharge lamp as claimed in claim 10 wherein the second parts of the electrode rods are made of molybdenum having a thickness between 120 $\mu$m and 350 $\mu$m.

18. A high-pressure gas discharge lamp as claimed in claim 10 wherein the electrode rods do not contain thorium.

19. A high-pressure gas discharge lamp as claimed in claim 10 wherein the first and second parts of the electrode rods are connected by laser welding.

20. A high-pressure gas discharge lamp as claimed in claim 10 wherein the lamp is defined by the following relation, $$f_{inw} >= 40\%$$

in which:

$f_{inw}$=fraction of length of the electrode rod enclosed in the wall of the lamp vessel.

21. A high-pressure gas discharge lamp comprising:

a lamp vessel which is closed in vacuumtight manner and has a wall enclosing a discharge space;

metal foils embedded in the wall of the lamp vessel and each connected to a respective external current conductor;

electrode rods each connected to a respective one of said metal foils and projecting from the wall of the lamp vessel into the discharge space;

wherein the electrode rods have first and second discrete parts electrically connected together at facing ends, said first parts projecting into the discharge space and consist essentially of tungsten, said second parts at least partly enclosed in the wall and consist essentially of molybdenum or tungsten-molybdenum alloys.

22. A high-pressure gas discharge lamp comprising:

a lamp vessel which is closed in vacuumtight manner and has a wall enclosing a discharge space;

metal foils embedded in the wall of the lamp vessel and each connected to a respective external current conductor;

electrode rods each connected to a respective one of said metal foils and projecting from the wall of the lamp vessel into the discharge space;

wherein the electrode rods have first and second discrete parts electrically connected together at facing ends, said first parts projecting into the discharge space and consisting essentially of tungsten, said second pans at least partly enclosed in the wall and consisting essentially of tungsten, molybdenum, tungsten-molybdenum alloys or tungsten, molybdenum and tungsten-molybdenum alloys, said electrode rods not comprising thorium.

23. A high-pressure gas discharge lamp comprising:

a lamp vessel which is closed in vacuumtight manner and has a quartz glass wall enclosing a discharge space;

metal foils embedded in the wall of the lamp vessel and each connected to a respective external current conductor;

electrode rods each connected to a respective one of said metal foils and projecting from the wall of the lamp vessel into the discharge space;

an ionizable filling in the discharge space;

the lamp being defined by the following relation, $$f_{inw} >= 40\%$$

in which:

$f_{inw}$=fraction of length of the electrode rod enclosed in the wall of the lamp vessel, the electrode rods having first and second discrete parts electrically connected together at facing ends, said first parts projecting into the discharge space, said second parts at least party enclosed in the wall and consisting essentially of tungsten, said second parts having a thickness between 120 $\mu$m and 180 $\mu$m, said first parts having a thickness greater than the thickness of said second parts.

* * * * *